US009227103B2

(12) United States Patent
Yang

(10) Patent No.: US 9,227,103 B2
(45) Date of Patent: Jan. 5, 2016

(54) FITNESS DEVICE

(71) Applicant: Rexon Industrial Corp., Ltd., Taichung (TW)

(72) Inventor: Shun-Chi Yang, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 148 days.

(21) Appl. No.: 14/212,274

(22) Filed: Mar. 14, 2014

(65) Prior Publication Data

US 2014/0274581 A1 Sep. 18, 2014

(30) Foreign Application Priority Data

Mar. 15, 2013 (TW) ..... 102109239 A

(51) Int. Cl.
*A63B 22/06* (2006.01)
*A63B 22/00* (2006.01)

(52) U.S. Cl.
CPC ..... *A63B 22/0605* (2013.01); *A63B 22/001* (2013.01); *A63B 22/0076* (2013.01); *A63B 22/0087* (2013.01); *A63B 2022/0005* (2013.01); *A63B 2022/0033* (2013.01); *A63B 2022/0035* (2013.01); *A63B 2022/0079* (2013.01); *A63B 2225/09* (2013.01); *A63B 2225/093* (2013.01)

(58) Field of Classification Search
CPC ..... A63B 2022/0652
See application file for complete search history.

(56) References Cited

U.S. PATENT DOCUMENTS

| | | | | |
|---|---|---|---|---|
| 5,071,117 | A * | 12/1991 | Mautner | A63B 21/00178 482/57 |
| 6,071,215 | A | 6/2000 | Raffo et al. | |
| 2013/0260964 | A1 | 10/2013 | Chia et al. | |
| 2013/0260965 | A1 | 10/2013 | Chia et al. | |
| 2013/0260966 | A1 | 10/2013 | Chia et al. | |
| 2013/0260967 | A1 | 10/2013 | Chia et al. | |

* cited by examiner

*Primary Examiner* — Loan H Thanh
*Assistant Examiner* — Rae Fischer
(74) *Attorney, Agent, or Firm* — Bacon & Thomas, PLLC

(57) ABSTRACT

A fitness device includes a body, a pedaling unit, a rotating unit, a seat unit, and at least one coupling unit. The coupling unit is pivotally mounted to the base and is coaxially aligned with the axle. The coupling unit is engaged with the rotating unit such that the rotating unit coaxially rotates with the coupling unit for driving the seat unit to convert between a first position in which the seat unit is located away from the base, and a second position in which the seat unit is located proximate to the base. A vertical distance and a horizontal distance between the seat unit and the pedaling unit are altered when converting between the first and second positions. By rotating the rotating unit, the horizontal and vertical distances between the seat and pedaling units are altered for allowing users to exercise in an upright posture or a recumbent posture.

17 Claims, 10 Drawing Sheets

FITNESS DEVICE

FIELD OF THE INVENTION

The present invention relates to a fitness device, and more specifically, to a fitness device which is convertible between an upright configuration and a recumbent configuration.

BACKGROUND

Referring to FIGS. 1 and 2, a multi-mode exercise machine 1 in accordance with U.S. Pat. No. 6,071,215 is disclosed. The multi-mode exercise machine comprises a base frame 11, a pedal unit 12 mounted to the base frame 11, a first seat 13 disposed on the pedal unit 12, a post 14 pivotally mounted to the base frame 11 and located on one lateral side of the pedal unit 12, a first handle 15 mounted to the post 14, a second seat 16 slidable along the post 14, a retractable pulling rope unit 17 pivotally mounted to the pedal unit 12, and a treadle unit 18 pivotally disposed on another end of the post 14. The pulling rope unit 17 includes a pulling rope 171 that is wound in the pedal unit 12, and a second handle 172.

When the post 14 is in an upright position, a user is able to sit on the first seat 13, and grasp on the first handle 15 using both hands while pedaling the pedal unit 12 for exercising. When the post 14 is in a horizontal position, the user is able to sit on the second seat 16 in a recumbent posture with pedals on the treadle unit 18. The user grasps on the second handle 172 with both hands for pulling the pulling rope 171, so that the retractable pulling rope 171 and the slidable second seat 16 allows the user to achieve an exercise effect. Thereby, the user is able to obtain different exercise effects by switching between an upright posture and a recumbent posture.

Despite the effects the aforementioned exercise machine 1 can provide, however, the exercise machine 1 requires two seats (first seat 13, second seat 16), two handles (first handle 15, second handle 172), and two pedal units (pedal unit 12, treadle unit 18). This structure of the exercise machine 1 is complicated and thus difficult to operate.

SUMMARY OF THE INVENTION

The present invention has been accomplished under the circumstances in view. It is therefore the main object of the present invention to provide a fitness device which has a simple structure that allows a user to exercise in either an upright posture or a recumbent posture, and which is easy to operate.

To achieve these and other objects of the present invention, a fitness device in accordance with the present invention comprises a body, a pedaling unit, a rotating unit, a seat unit, and at least one coupling unit. The body has a base, and an axle passes through the base and defines a longitudinal axis which passes through a center of the axle. The pedaling unit has two pedals which are respectively mounted to two ends of the axle. The rotating unit is rotatable around the axis. The seat unit is mounted to the rotating unit. The at least one coupling unit is pivotally mounted to the base and is coaxially aligned with the axle. The coupling unit is engaged with the rotating unit such that the rotating unit coaxially rotates with the coupling unit for driving the seat unit to convert between a first position in which the seat unit is located away from the base, and a second position in which the seat unit is located proximate to the base. A vertical distance and a horizontal distance between the seat unit and the pedaling unit is altered when converting between the first position and the second position.

An advantage of the present invention is that by rotating the rotating unit, the horizontal and vertical distance between the seat unit and the pedaling unit is altered for allowing the user to exercise in an upright posture or a recumbent posture as desired.

BRIEF DESCRIPTION OF THE DRAWINGS

Other advantages and features of the present invention will be understood by reference to the following specification in conjunction with the accompanying drawings, in which like reference characters denote like elements of structure.

Figure 1:
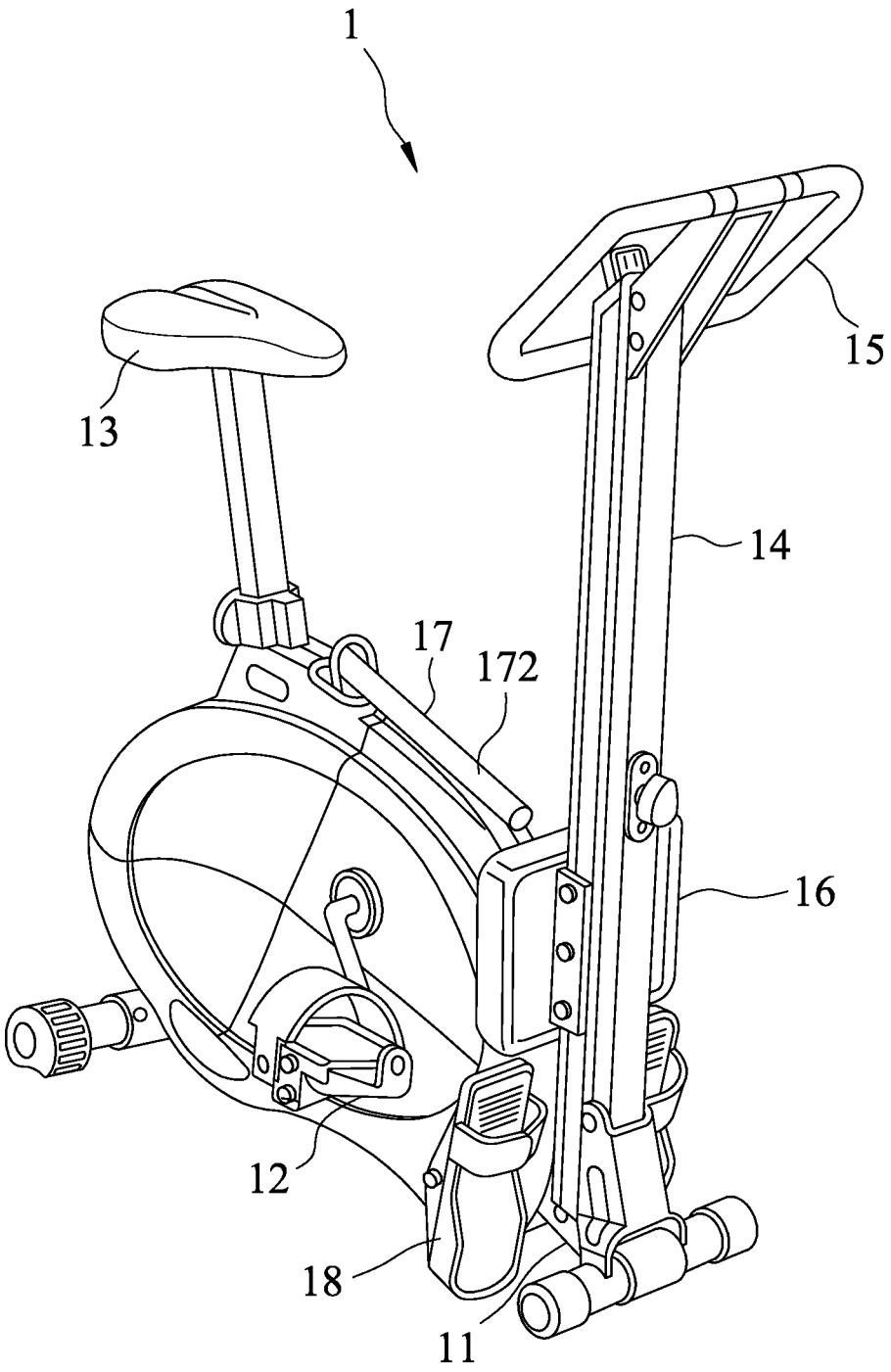
FIG. 1 PRIOR ART
FIG. 1 is a perspective view of a multi-mode exercise equipment in accordance with U.S. Pat. No. 6,071,215.
Figure 2:
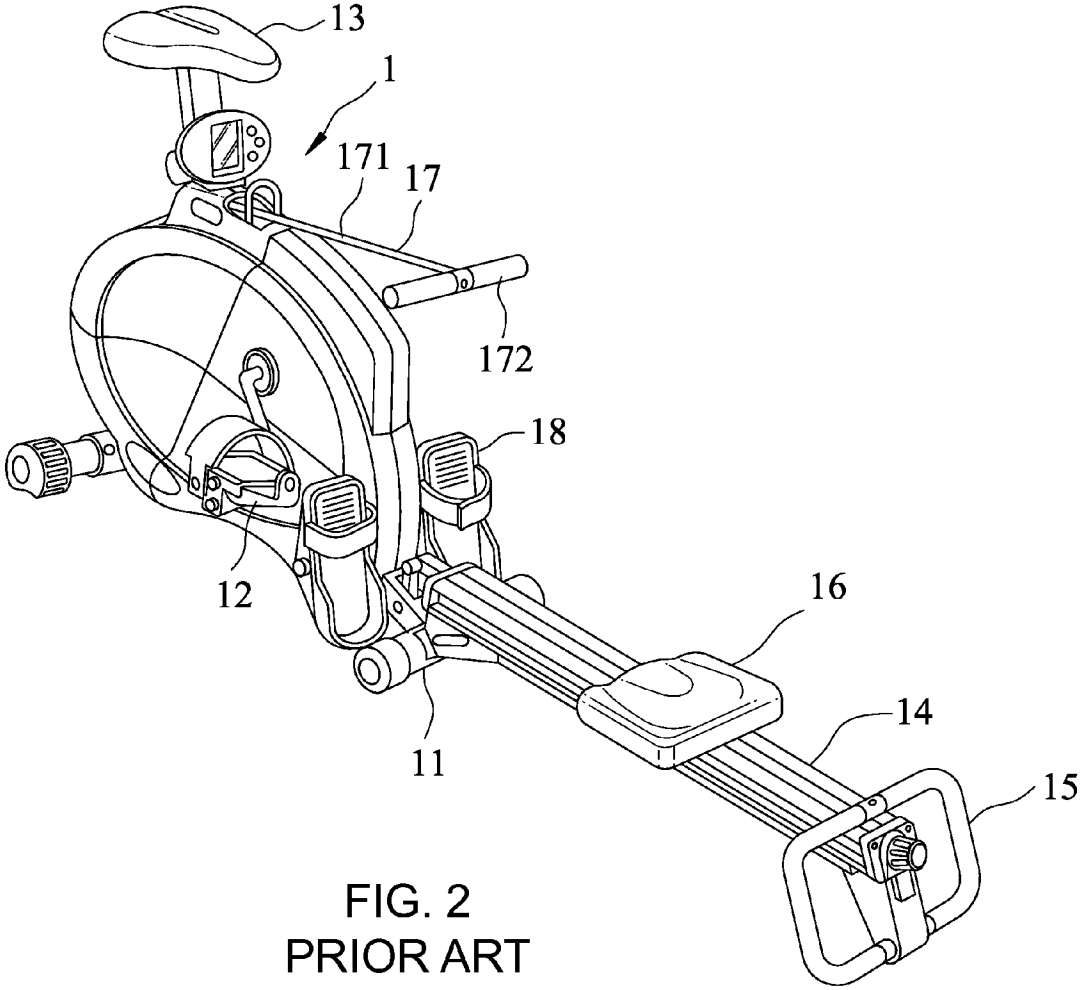
FIG. 2 PRIOR ART
FIG. 2 is a perspective view of a multi-mode exercise equipment in an operation state in accordance with U.S. Pat. No. 6,071,215.

It should be noted that the drawing figures are not necessarily drawn to scale, but instead are drawn to provide a better understanding of the components thereof, and are not intended to be limiting in scope, but rather to provide exemplary illustrations. It should further be noted that the figures illustrate an exemplary embodiment of a fitness device and the components thereof, and in no way limits the structures, configurations and components thereof according to the present disclosure.

DETAILED DESCRIPTION

Figure 3:
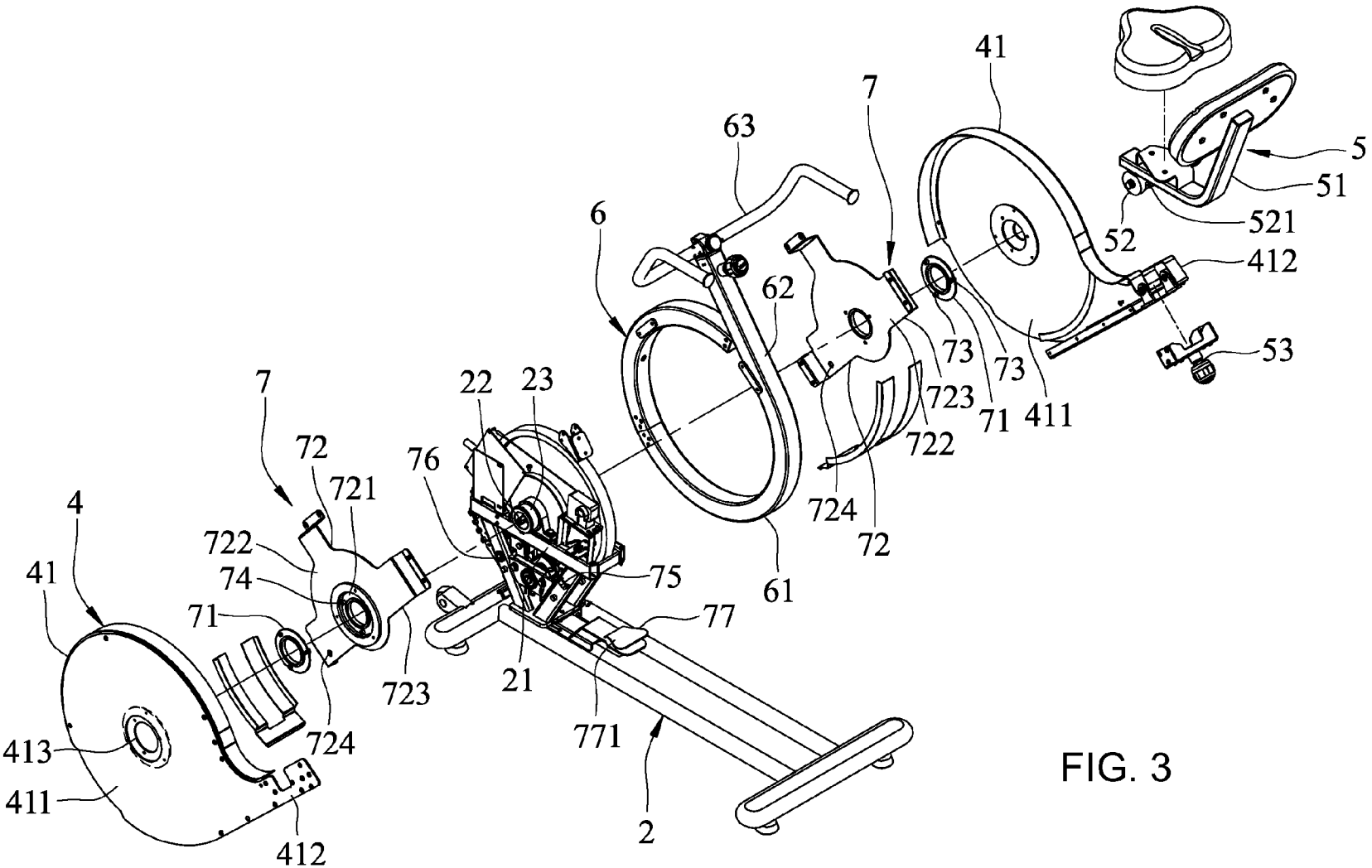
FIG. 3 is an exploded view of a fitness device in accordance with a preferred embodiment of the present invention.
Figure 4:
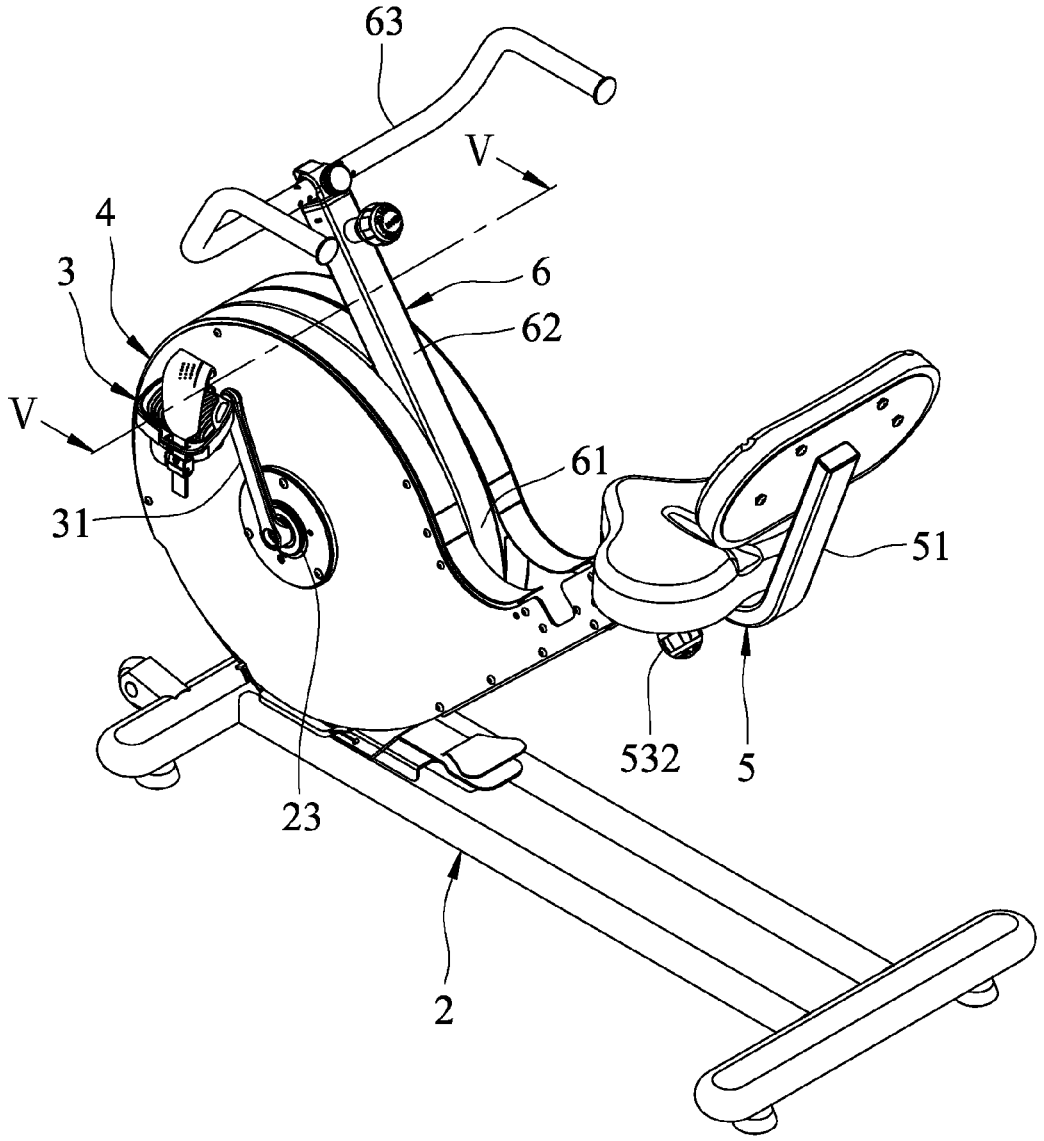
FIG. 4 is an assembled perspective view of the fitness device in accordance with the preferred embodiment of the present invention.

Referring to FIGS. 3 and 4, a preferred embodiment of the fitness device in accordance with the present invention comprises a body 2, a pedaling unit 3, a rotating unit 4, a seat unit 5, a handle unit 6, and two coupling units 7. The body 2 has a base 21, an axle 22 passing through the base 21 defining a longitudinal axis X which passes through a center of the axle 22. Two axle sleeves 23 are respectively disposed on two opposite ends of the axle 22 and are secured to the base 21. The pedaling unit 3 has two pedals 31 respectively mounted to two ends of the axle 22.

Figure 5:
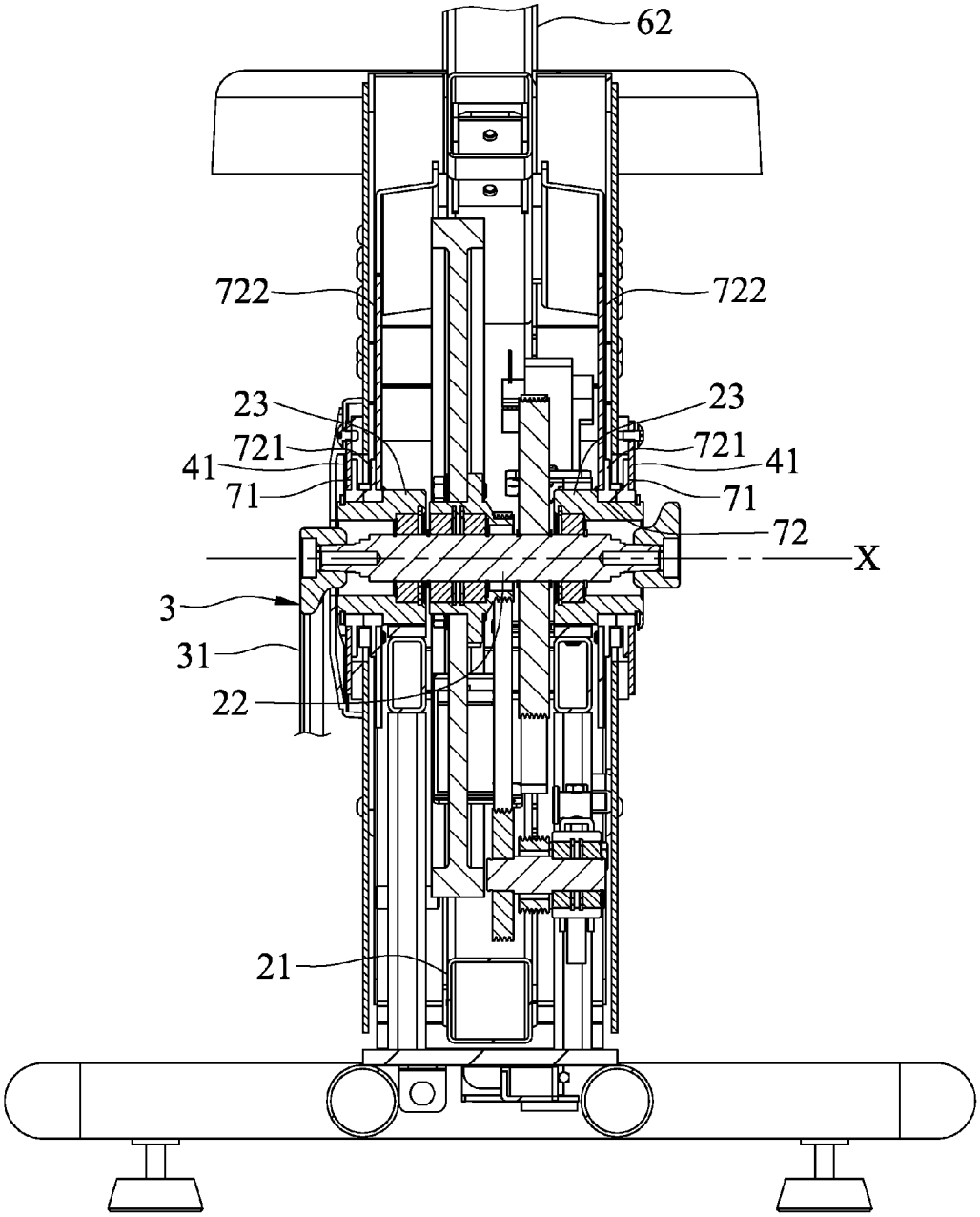
FIG. 5 is a cross-sectional view taken along V-V in FIG. 4.

Further referring to FIGS. 3 and 5, the rotating unit 4 is rotatable around the axis X, and has two panels 41 which are respectively located on two lateral sides of the base 21. Each panel 41 has a swing member 411 which radially extends outward from the axis X for engaging with the coupling unit 7, and wherein the swing member 411 has an extending portion 412 biasedly and outwardly extending therefrom. A hole 413 is axially defined in the panel 41 which is adapted for accommodating the axle 22.

Figure 6:
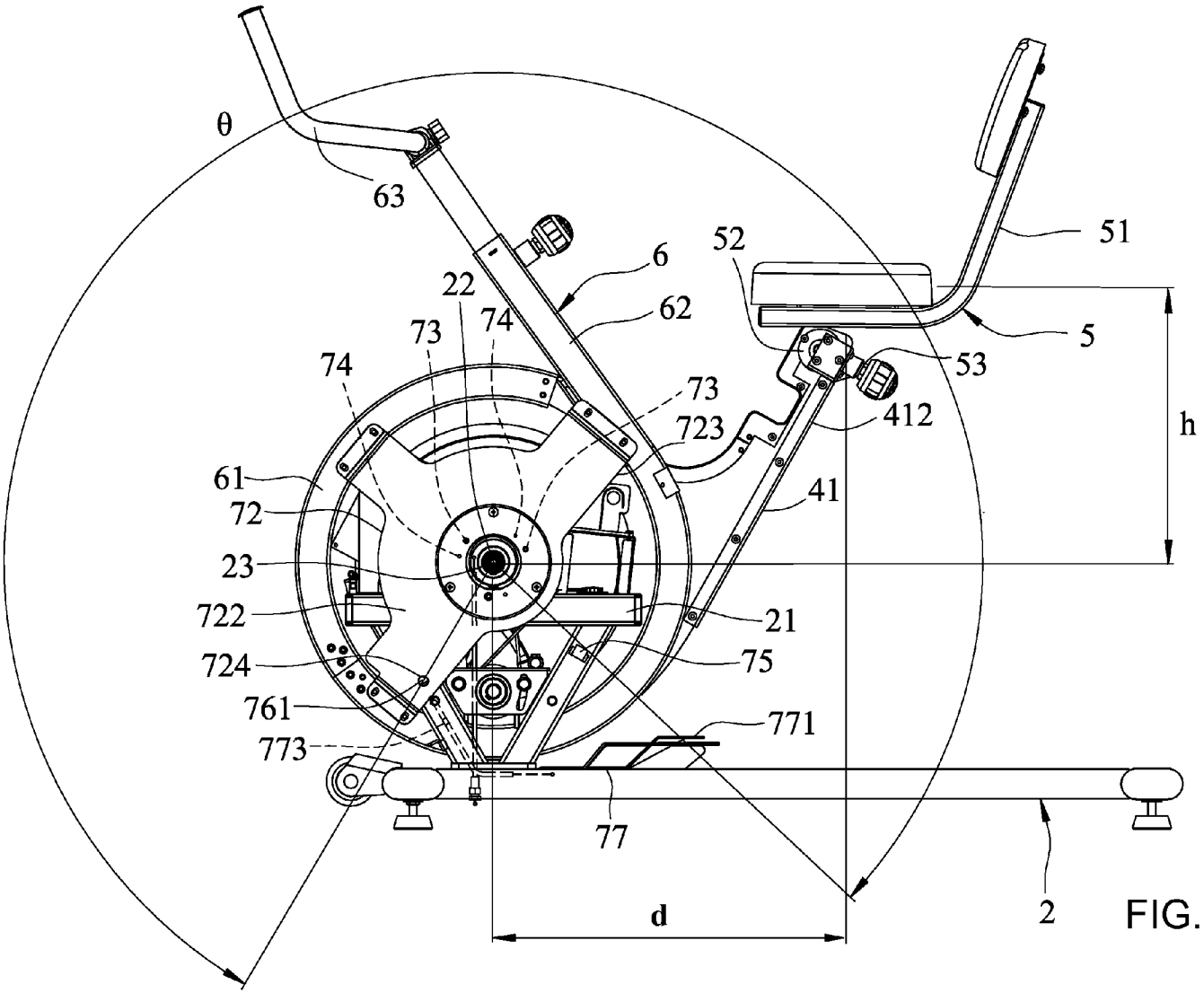
FIG. 6 is a side elevation view of the fitness device in accordance with the preferred embodiment of the present invention illustrating a vertical distance between the seat unit and the pedaling unit gradually increases; wherein a horizontal distance between the seat unit and the pedaling unit gradually decreases.
Figure 7:
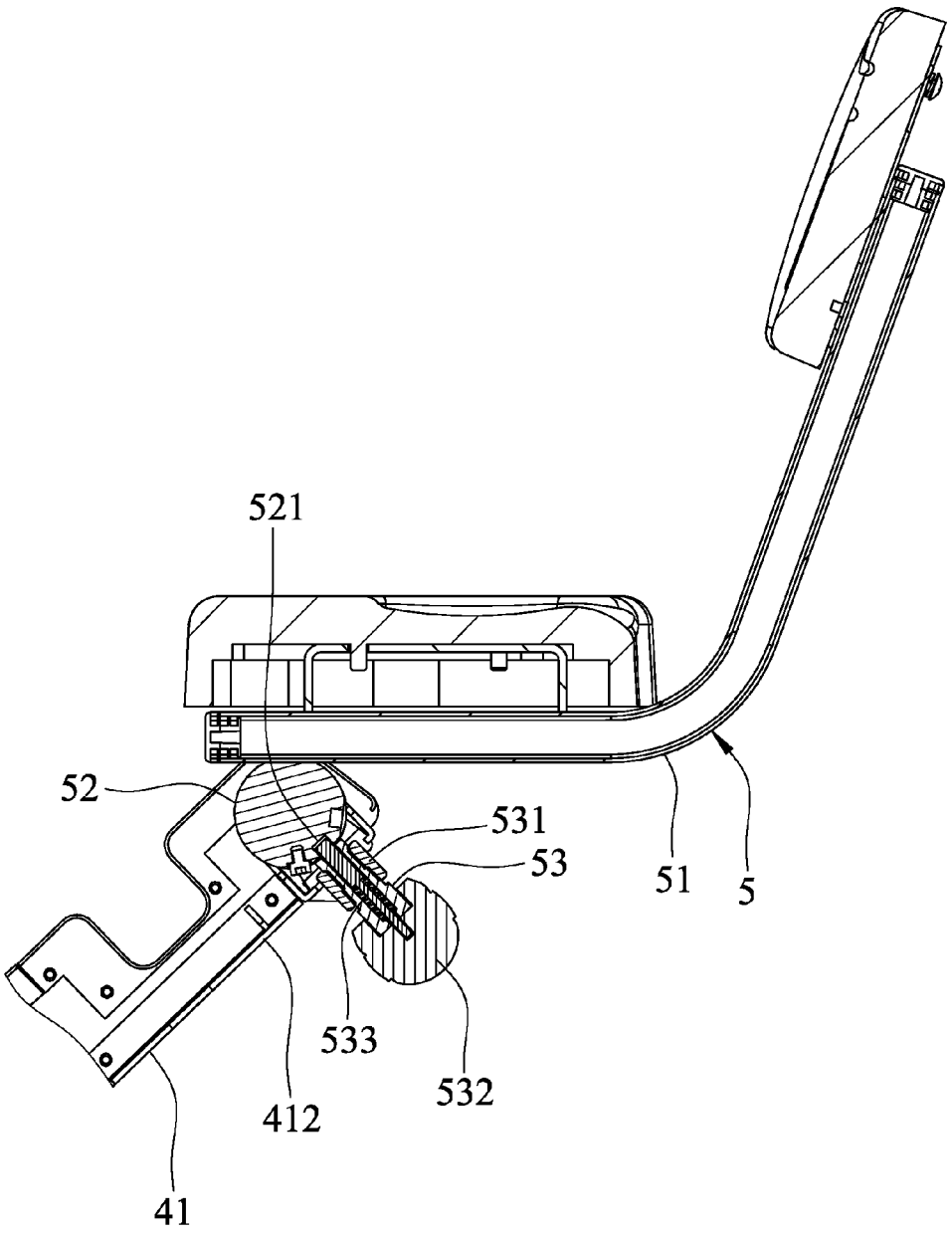
FIG. 7 is a cross-sectional view of the seat unit of the fitness device in accordance with the preferred embodiment of the present invention.
Figure 8:
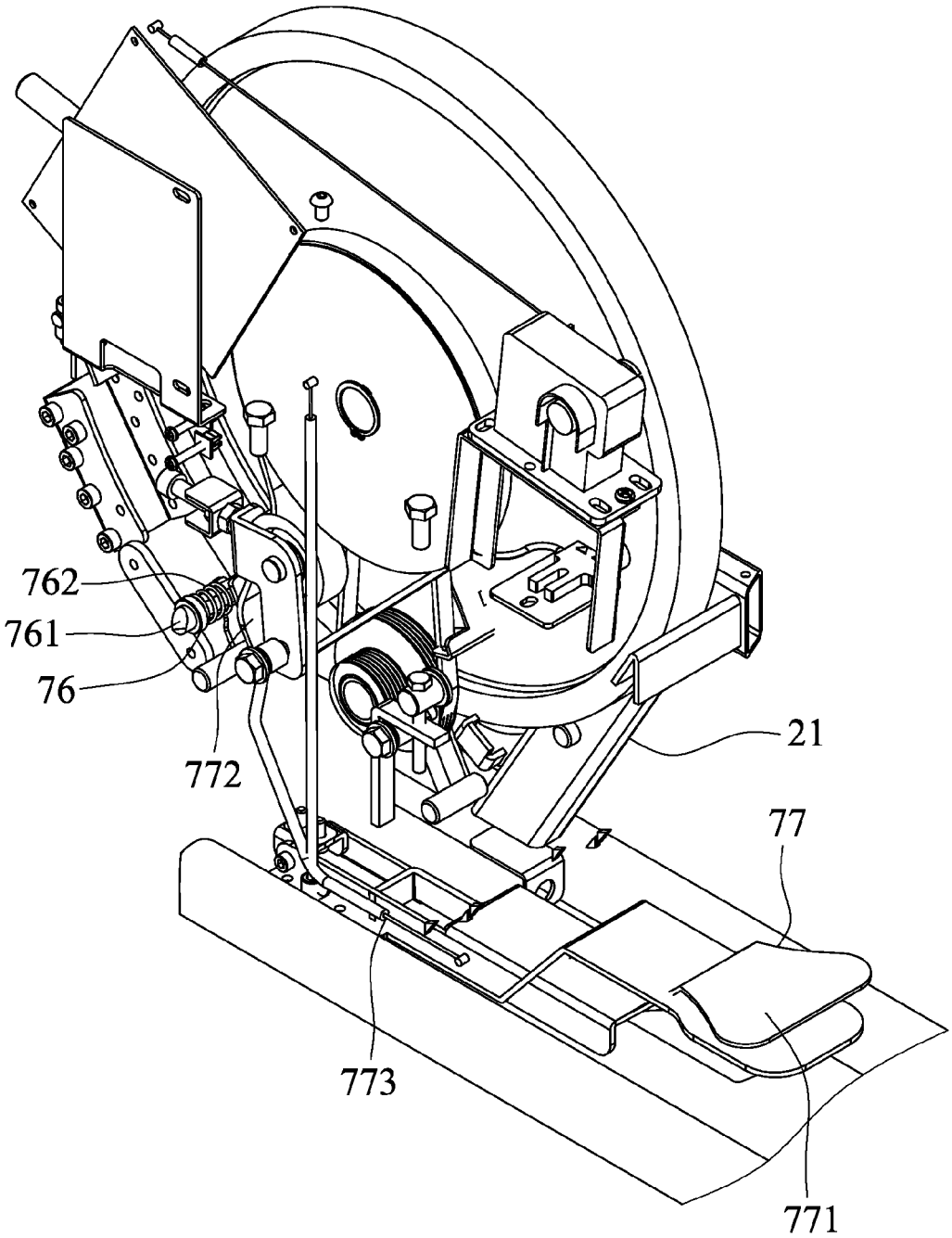
FIG. 8 is a perspective view illustrating a driving unit driving a second stopper in accordance with the preferred embodiment of the present invention.

Referring to FIGS. 3 and 6-7, the seat unit 5 is mounted to the extending portion 412 of the panel 41. The seat unit 5 has a frame 51 and a rotating member 52. The rotating member 52 is mounted to a bottom of the frame 51 and is located between the extending portions 412 of the panels 41 along a horizontal direction which is substantially parallel to the axis X. A positioning member 53 is engaged with the rotating member 52. The rotating member 52 has a plurality of notches 521 defined in an outer surface thereof. The positioning member 53 has a fastening member 531 secured between the two extending portions 412 of the two panels 41. A bolt 532 is disposed on the fastening member 531 for selectively engaging with one of the notches 521. A spring 533 is disposed between the fastening member 531 and the bolt 532 for constantly urging the bolt 532 to engage with one of the notches 521. Thereby, when the bolt 532 is disengaged from the notch 521, the frame 51 is rotatable around the rotating member 52 for allowing adjustment of an inclined angle of the frame 51.

Referring to FIGS. 3 and 6, the handle unit 6 has a turnable member 61 which is rotatable around the axis X. A post 62 outwardly extends from the turnable member 61. A gripping member 63 is mounted to the post 62.

Referring to FIGS. 3, 5, 6 and 8, the two coupling units 7 are pivotally mounted to the base 21 and are co-axial with the axis X. The two coupling units 7 are located between the two panels 41 of the rotating unit 4. Each coupling unit 7 comprises a first coupling member 71, a second coupling member 72, two first limiters 73, two second limiters 74, one first stopper 75, one second stopper 76, and a driving unit 77.

In the present embodiment, the first coupling member 71 is a rotatable ring which axially and rotatably sleeves on an outer periphery of the axle sleeve 23, and correspondingly engages with the panel 41 for coupling with the panel 41, such that the first coupling member 71 and the panel 41 can be simultaneously driven.

The second coupling member 72 comprises a rotatable ring 721 that axially and rotatably sleeves on the outer periphery of the axle sleeve 23, and a pawl member 722 for coupling the rotatable ring 721 with the turnable member 61 of the handle unit 6. The pawl member 722 has a first refraining portion 723 and a second refraining portion 724 formed thereon. The first refraining portion 723 and the second refraining portion 724 are substantially radially located from the axis X such that an included angle is formed therebetween. In the present embodiment, the first refraining portion 723 is formed on an end portion of the pawl member 722, and the second refraining portion 724 is a plug hole.

In the present embodiment, each first limiter 73 is a stud which is protrudingly disposed on a surface of the first coupling member 71. The first limiters 73 are radially located from the axis X and are arranged relative to each other at an interval such that an included angle is formed between the first limiters 73 and the axis X.

Figure 10:
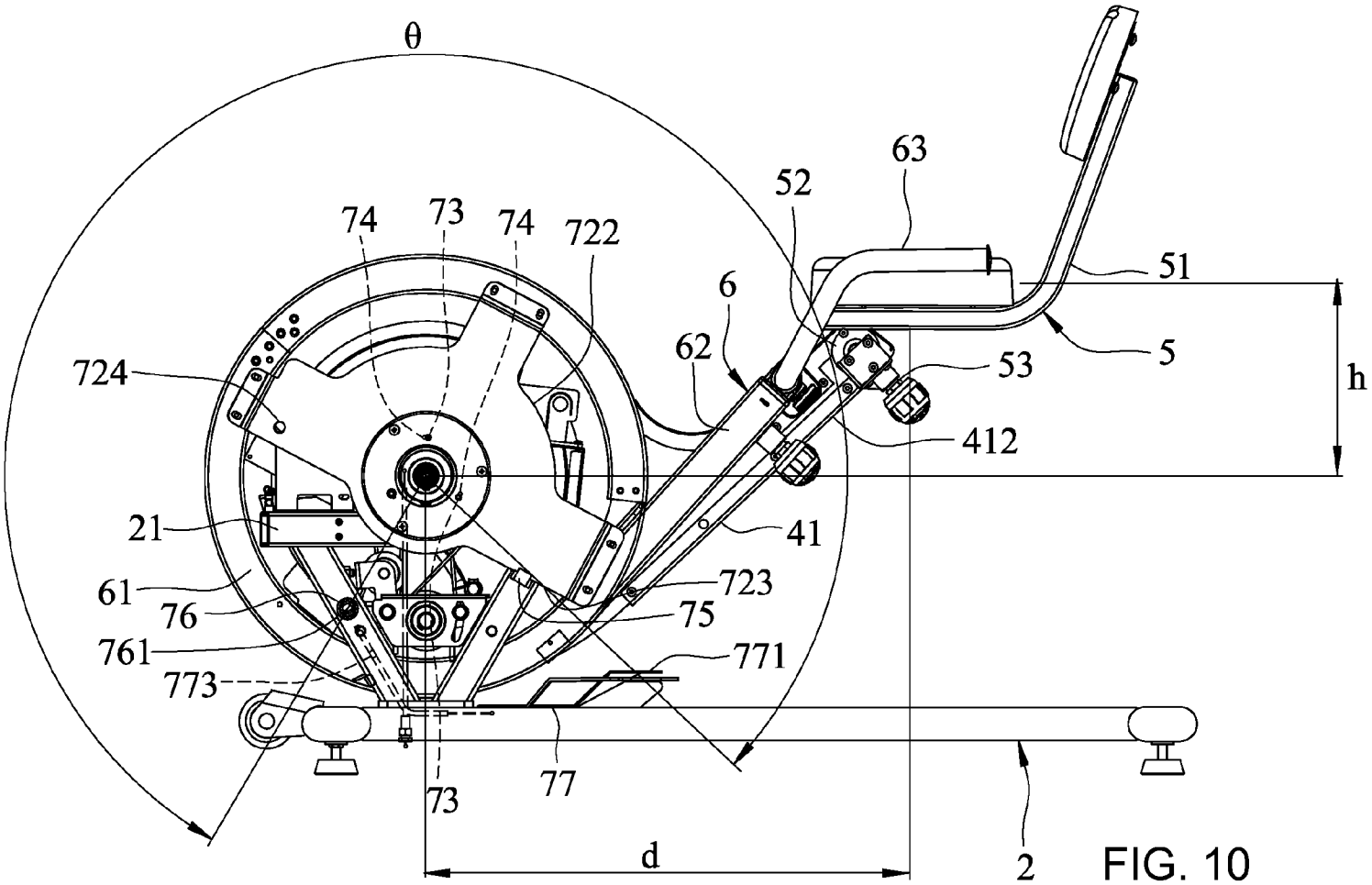
FIG. 10 is a side elevation view of the fitness device in accordance with the preferred embodiment of the present invention illustrating a vertical distance between the seat unit and the pedaling unit gradually decreases; wherein a horizontal distance between the seat unit and the pedaling unit gradually increases.

Each second limiter 74 is likewise a stud in the present embodiment. The second limiters 74 are disposed on a surface of the rotatable ring 721 and are simultaneously rotatable with the second coupling members 72 between an idle motion and a linkage motion (i.e. they are movable with a rotation of the second coupling member). In the idle motion, the second limiter 74 rotatably travels within a distance between the two first limiters 73, as shown in FIG. 6. In the linkage motion, the second limiter abuts against one of the first limiters 73 for driving the first coupling member 71 to rotate therewith, as shown in FIG. 10.

The first stopper 75 and the second stopper 76 are disposed on the base 21 and are radially located from the axis X, such that the first stopper 75 and the second stopper 76 define a predetermined travel range θ, wherein the first stopper 75 is located at a beginning of the travel range θ. The second stopper 76 has a pin 761, and is located at a termination of the predetermined travel range θ. A resilient member 762, such as a spring, is disposed on the pin 761 for resiliently urging the pin 761 to engage with the second refraining portion 724 of the second coupling unit 7.

The driving unit 77 has a treadle 771 which is pivotally mounted to the base 21, a pivot seat 772 which is pivotally mounted to the base 21 and pivotally connected to the pin 761, and a linking member 773 for linking the treadle 771 with the pivot seat 772. By exerting a force on the treadle 771, the linking member 773 is driven to drive the pivot seat 772 to swing such that the pivot seat 772 drives the pin 761 to disengage from the second refraining portion 724.

Figure 9:
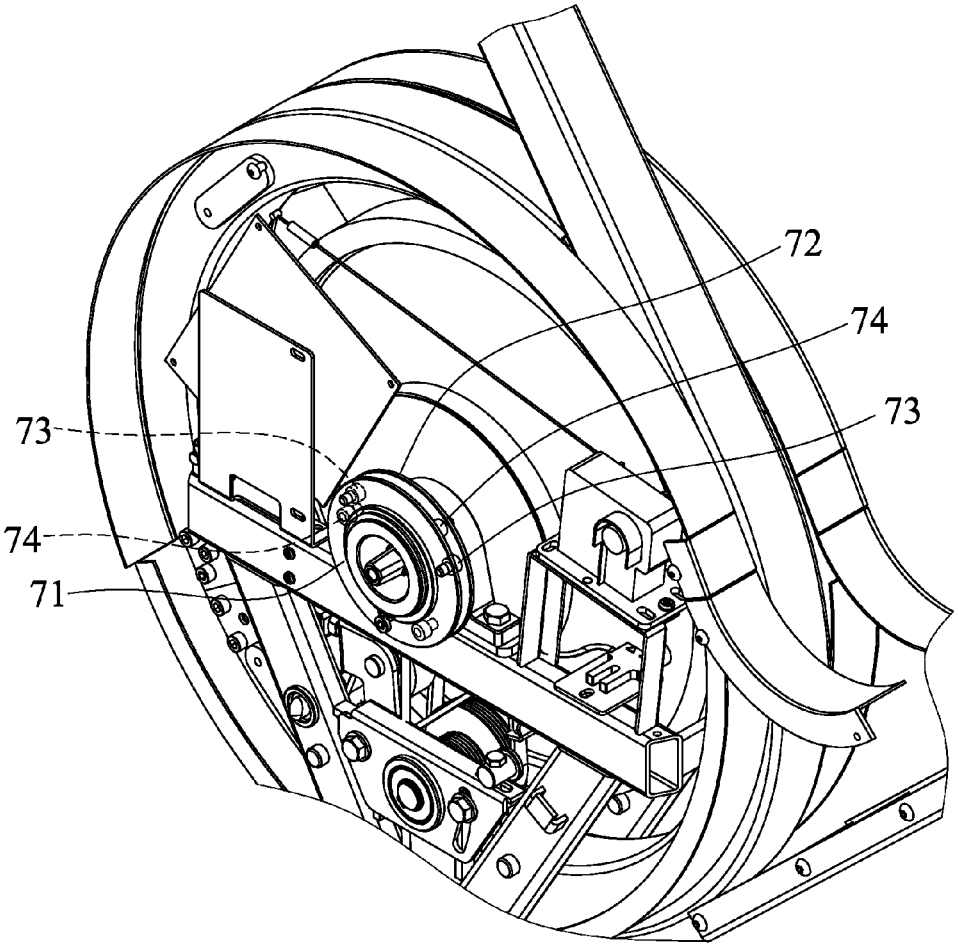
FIG. 9 is a perspective view illustrating a second limiter in accordance with the preferred embodiment of the present invention at an idle motion; wherein the second limiter is located between two first limiters.

Referring to FIGS. 5, 6 and 9, when a user pushes the gripping member 63 of the handle unit 6 along an anti-clockwise direction, the turnable member 61 rotates therewith such that each second coupling member 72 is driven by the turnable member 61 to rotate along the anti-clockwise direction, and each second limiter 74 rotatably travels with the second coupling member until the second limiter 74 eventually abuts against the corresponding first limiter 73. Thereby, the second limiter 74 is at the linkage motion for driving the first coupling member 71 to rotate therewith, such that the panel 41 is also driven to rotate along the anti-clockwise direction. The seat unit 5 moves with the rotation of the panel 41 until the second refraining portion 724 of the pawl member 722 corresponds to the pin 761 of the second stopper 76. The pin 761, which is resiliently and constantly urged by the resilient member 762, resiliently engages with the second refraining portion 724 (the plug hole). The first coupling member 71 and the second coupling member 72 are therefore securely positioned. At this point, a vertical distance (h) between the seat unit 5 and the pedaling unit 3 has reached its maximum. On the other hand, a horizontal distance (d) between the seat unit 5 and the pedaling unit 3 has reached its minimum. The seat unit 5 is located at a first position that is located away from the base 21 for allowing the user to exercise in a substantially upright posture.

Further referring to FIGS. 5, 6, 8 and 10, when the user steps on the treadle 771, the linking member 773 is driven to drive the pivot seat 772 to drive the pin 761 to disengage from the second refraining portion 724 (plug hole). By pushing the gripping member 63 along a clockwise direction, the turnable member 61 rotates therewith such that the each second coupling member 72 is driven by the turnable member 61 to rotate along the clockwise direction, and each second limiter 74 rotatably travels with the second coupling member until the second limiter 74 eventually abuts against the corresponding first limiter 73. Thereby, the second limiter 74 is at the linkage motion for driving the first coupling member 71 to rotate therewith, and the panel 41 is also driven to rotate along the clockwise direction. The seat unit 5 moves with the rotation of the panel 41 until the first refraining portion 723 of the pawl member 722 is stopped by the first stopper 75. The first coupling member 71 and the second coupling member 72 are therefore securely positioned.

At this point, the vertical distance (h) between the seat unit 5 and the pedaling unit 3 has reached its minimum. On the other hand, the horizontal distance (d) between the seat unit 5 and the pedaling unit 3 has reached its maximum. The seat unit 5 is located at a second position, wherein it is located proximate to the base 21 for allowing the user to exercise in a substantially recumbent posture.

It is worth mentioning that, by rotating the seat unit 5, the first limiter 73 is driven to drive the second limiter 74, such that the handle unit 6 is driven. Further, in addition to the first stopper 75 and the second stopper 76, additional stoppers may be added such that the second coupling member 72 can be positioned in multi-angles within the travel range θ.

In view of the above, the fitness device in accordance with the present invention has many advantages. By utilizing the coupling unit 7, the handle unit 6 and the seat unit 5 are movable with a predetermined range such that the horizontal distance (d) and the vertical distance (h) between the seat unit 5 and the pedaling unit 3 can be altered. Thereby, the positions of the seat unit 5 relative to the pedaling unit 3 are convertible between an upright posture or a recumbent posture without the need for an additional seat unit 5 and pedaling unit 3. Therefore, the structure of the present invention is simplified and thus easy to operate.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A fitness device comprising:

a body having a base, an axle passing through the base defining a longitudinal axis which passes through a center of the axle;

a pedaling unit having two pedals respectively mounted to two ends of the axle;

a rotating unit rotatable around the axis;

a seat unit mounted to the rotating unit;

at least one coupling unit pivotally mounted to the base and coaxially aligned with the axle; wherein the coupling unit includes at least one first coupling member pivotally mounted to the base and coaxially aligned with the longitudinal axis, and wherein the first coupling member is engaged with the rotating unit; and a handle unit having a turntable member rotatable around the longitudinal axis, and a post outwardly extending from the turntable member, wherein the coupling unit includes at least a second coupling member pivotally mounted to the base, coaxially aligned with the axle, and engaged with the turnable member of the handle unit, wherein the coupling unit is engaged with the rotating unit such that the rotating unit coaxially rotates with the coupling unit for driving the seat unit and handle unit to convert between a first position in which the seat unit is located away from the base and a second position in which the seat unit is located proximate to the base, wherein a vertical distance and a horizontal distance between the seat unit and the pedaling unit is altered when converting between the first position or the second position, and wherein the fitness device is operable by rotation of the pedals in both positions.

2. A fitness device as claimed in claim 1, wherein the second coupling member includes a rotatable ring axially disposed along the axis, and a pawl member for securing the rotatable ring with the turnable member.

3. A fitness device as claimed in claim 1, wherein the rotating unit includes at least one panel engaged with the coupling unit, the at least one panel having a hole axially defined therein and adapted to accommodate the axle, a swing member radially extending outward from the axis for engaging with the coupling unit, the swing member having an extending portion biasedly and outwardly extending therefrom, and wherein the seat unit is mounted to the extending portion.

4. A fitness device as claimed in claim 3, wherein the rotating unit includes two panels respectively located on two lateral sides of the base, and two coupling units disposed between the two panels, wherein the two first coupling members are respectively engaged to the swing members of the two panels, and the two second coupling members are respectively coupled to opposite sides of the turnable member of the handle unit.

5. A fitness device as claimed in claim 3, wherein the seat unit includes a frame, a rotating member mounted to a bottom of the frame, and a positioning member engaged with the rotating member, the rotating member having a plurality of notches defined in an outer surface thereof, the positioning member having a fastening member secured between the two extending portions of the two panels, and a bolt disposed on the fastening member for selectively engaging with one of the notches.

6. A fitness device as claimed in claim 1, wherein the body includes at least one axle sleeve disposed around the axle, and wherein the first coupling member and the second coupling member are respectively and rotatably sleeved on the axle sleeve.

7. A fitness device as claimed in claim 2, wherein the body includes at least one axle sleeve disposed around the axle, and wherein the first coupling member and the second coupling member are respectively and rotatably sleeved on the axle sleeve.

8. A fitness device as claimed in claim 1, wherein the second coupling member includes at least one second limiter formed thereon, and the first coupling member includes two first limiters formed thereon and radially located from the axis, wherein the two first limiters are intervally arranged relative to each other such that an included angle is formed between the two first limiters and the axis; and wherein the second limiter is rotatable with the second coupling member between an idle motion and a linkage motion, such that the second limiter travels within a distance between the two first limiters when in the idle motion, and the second limiter abuts against one of the first limiters for driving the first coupling member to rotate therewith when in the linkage motion.

9. A fitness device as claimed in claim 2, wherein the second coupling member includes at least one second limiter formed thereon, and the first coupling member includes two first limiters formed thereon and radially located from the axis, wherein the two first limiters are intervally arranged relative to each other such that an included angle is formed between the two first limiters and the axis; and wherein the second limiter is rotatable with the second coupling member between an idle motion and a linkage motion, such that the second limiter travels within a distance between the two first limiters when in the idle motion, and the second limiter abuts against one of the first limiters for driving the first coupling member to rotate therewith when in the linkage motion.

10. A fitness device as claimed in claim 1, wherein the coupling unit comprises a first stopper and a second stopper disposed on the base and radially located from the axis, the first and second stoppers intervally arranged relative to each other such that an included angle is formed between the stoppers and the axis, the second coupling member having a first refraining portion and a second refraining portion formed thereon and radially located from the axis such that an included angle is formed therebetween, wherein the first and second stoppers are arranged to respectively block the first refraining portion and the second refraining portion for refraining the second coupling member to rotatably move within a predetermined range.

11. A fitness device as claimed in claim 2, wherein the coupling unit comprises a first stopper and a second stopper disposed on the base and radially located from the axis, the first and second stoppers intervally arranged relative to each other such that an included angle is formed between the stoppers and the axis, the second coupling member having a first refraining portion and a second refraining portion formed thereon and radially located from the axis such that an included angle is formed therebetween, wherein the first and second stoppers are arranged to respectively block the first refraining portion and the second refraining portion for refraining the second coupling member to rotatably move within a predetermined range.

12. A fitness device as claimed in claim 10, wherein the first stopper is located at a beginning of the predetermined range, and wherein the second coupling member is at the beginning of the predetermined range when the first refraining portion abuts against the first stopper.

13. A fitness device as claimed in claim 11, wherein the first stopper is located at a beginning of the predetermined range, and wherein the second coupling member is at the beginning of the predetermined range when the first refraining portion abuts against the first stopper.

14. A fitness device as claimed in claim 12, wherein the coupling unit has a driving unit, the second refraining portion of the second coupling member being a plug hole, the second stopper having a pin and located at a termination of the predetermined range, and a resilient member disposed on the pin for resiliently urging the pin to engage with the plug hole, and wherein the driving unit is arranged to drive the pin to disengage from the second refraining portion by exerting an external force on the driving unit.

15. A fitness device as claimed in claim 13, wherein the coupling unit has a driving unit, the second refraining portion of the second coupling member being a plug hole, the second stopper having a pin and located at a termination of the predetermined range, and a resilient member disposed on the pin for resiliently urging the pin to engage with the plug hole, and wherein the driving unit is arranged to drive the pin to disengage from the second refraining portion by exerting an external force on the driving unit.

16. A fitness device as claimed in claim 14, wherein the driving unit includes a treadle pivotally mounted to the base, a pivot seat pivotally mounted to the base and pivotally connected to the pin, and a link for linking the treadle with the pivot seat, and wherein the link is driven to drive the pivot seat to swing such that the pivot seat drives the pin to disengage from the second refraining portion by exerting a force on the treadle.

17. A fitness device as claimed in claim 15, wherein the driving unit includes a treadle pivotally mounted to the base, a pivot seat pivotally mounted to the base and pivotally connected to the pin, and a link for linking the treadle with the pivot seat, and wherein the link is driven to drive the pivot seat to swing such that the pivot seat drives the pin to disengage from the second refraining portion by exerting a force on the treadle.

* * * * *